US011458728B2

(12) United States Patent
Miyazawa et al.

(10) Patent No.: US 11,458,728 B2
(45) Date of Patent: Oct. 4, 2022

(54) LIQUID EJECTING APPARATUS CONTROL METHOD AND LIQUID EJECTING APPARATUS

(71) Applicant: SEIKO EPSON CORPORATION, Tokyo (JP)

(72) Inventors: Hiromu Miyazawa, Azumino (JP); Kinya Ozawa, Shiojiri (JP); Jiro Kato, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 17/036,319

(22) Filed: Sep. 29, 2020

(65) Prior Publication Data

US 2021/0094292 A1 Apr. 1, 2021

(30) Foreign Application Priority Data

Sep. 30, 2019 (JP) ..... JP2019-179651

(51) Int. Cl.
*B41J 2/055* (2006.01)
*B41J 2/165* (2006.01)
*B41J 2/185* (2006.01)

(52) U.S. Cl.
CPC ..... *B41J 2/055* (2013.01); *B41J 2/165* (2013.01); *B41J 2/185* (2013.01)

(58) Field of Classification Search
CPC ... B41J 2/055; B41J 2/165; B41J 2/185; B41J 2/04541; B41J 2/04588; B41J 2/0459; B41J 2/04596; B41J 2002/14241; B41J 2/14233; B41J 2002/14354; B41J 2002/14362; B41J 2002/14419; B41J 2002/14475; B41J 2002/14491; B41J 2202/11; B41J 2/04571; B41J 2/04581; B41J 2/0451; B41J 2/01; B41J 2/14201
See application file for complete search history.

(56) References Cited

U.S. PATENT DOCUMENTS 9,782,968 B2 * 10/2017 Tobita ..... B41J 2/1652
2015/0258780 A1 9/2015 Hayashi

FOREIGN PATENT DOCUMENTS

JP 2004-299341 A 10/2004

OTHER PUBLICATIONS

IP.com search (Year: 2021).*

* cited by examiner

*Primary Examiner* — Lisa Solomon
(74) *Attorney, Agent, or Firm* — Workman Nydegger

(57) ABSTRACT

In a method of controlling a liquid ejecting apparatus, where the liquid ejecting apparatus includes a pressure chamber that communicates with a nozzle that ejects a liquid, a drive element that changes a pressure of the liquid in the pressure chamber, and a drive circuit that supplies the drive element with an ejection pulse that generates a change in the pressure that ejects the liquid from the nozzle, the method includes specifying a viscosity of the liquid in the nozzle and a surface tension of the liquid in the nozzle from a residual vibration when the pressure of the liquid in the pressure chamber is changed, and controlling a waveform of the ejection pulse according to the viscosity and the surface tension.

16 Claims, 13 Drawing Sheets

| SYMBOL | PHYSICAL QUANTITY | TYPICAL VALUES |
|---|---|---|
| $\rho'$ | GAS DENSITY | 1.0 kg/m$^3$ |
| $\rho$ | INK DENSITY | 997.0 kg/m$^3$ |
| $\eta$ | INK VISCOSITY | 4.0 mPa·s |
| $\gamma$ | INK SURFACE TENSION | 30.0 mN/m |
| a | DISTANCE BETWEEN NOZZLE AND MEDIUM | 1000 $\mu$m |
| b | NOZZLE LENGTH | 30–50 $\mu$m |
| $\phi$1 | NOZZLE DIAMETER | 16–25 $\mu$m |
| P | INJECTION PRESSURE | 2.0–4.0 atm |

LIQUID EJECTING APPARATUS CONTROL METHOD AND LIQUID EJECTING APPARATUS

The present application is based on, and claims priority from JP Application Serial Number 2019-179651, filed Sep. 30, 2019, the disclosure of which is hereby incorporated by reference herein in its entirety.

BACKGROUND

1. Technical Field

The present disclosure relates to a liquid ejecting apparatus and a control method thereof.

2. Related Art

A liquid ejecting apparatus that ejects a liquid such as ink onto a medium such as printing paper has been offered in the related art. In the liquid ejecting apparatus, the characteristics such as the viscosity of the liquid may change due to, for example, the water content of the ink solvent evaporating from the nozzle. JP-A-2004-299341 discloses a technique in which the viscosity of a liquid is detected by analyzing the vibration that remains in the pressure chamber when the pressure of the liquid in the pressure chamber is changed (hereinafter referred to as a "residual vibration").

In the technique of JP-A-2004-299341, when an abnormality is detected according to the viscosity detected from the residual vibration, a recovery process is executed to eliminate the cause of the abnormality. Therefore, in the period before the execution of the recovery process, there is a possibility that the error relating to the ejection characteristics of the liquid may not be sufficiently reduced.

SUMMARY

According to an aspect of the present disclosure, in a method of controlling a liquid ejecting apparatus, where the liquid ejecting apparatus includes a pressure chamber that communicates with a nozzle that ejects a liquid, a drive element that changes a pressure of the liquid in the pressure chamber, and a drive circuit that supplies the drive element with an ejection pulse that generates a change in the pressure that ejects the liquid from the nozzle, the method includes specifying a viscosity of the liquid in the nozzle and a surface tension of the liquid in the nozzle from a residual vibration when the pressure of the liquid in the pressure chamber is changed, and controlling a waveform of the ejection pulse according to the viscosity and the surface tension.

According to another aspect of the present disclosure, a liquid ejecting apparatus includes a pressure chamber that communicates with a nozzle that ejects a liquid, a drive element that changes a pressure of the liquid in the pressure chamber, a drive circuit that supplies the drive element with an ejection pulse that generates a change in the pressure that ejects the liquid from the nozzle, a specifying unit that specifies a viscosity of the liquid in the nozzle and a surface tension of the liquid in the nozzle from a residual vibration when the pressure of the liquid in the pressure chamber is changed, and a controller that controls a waveform of the ejection pulse according to the viscosity and the surface tension.

DESCRIPTION OF EXEMPLARY EMBODIMENTS

A: Embodiment

Figure 1:
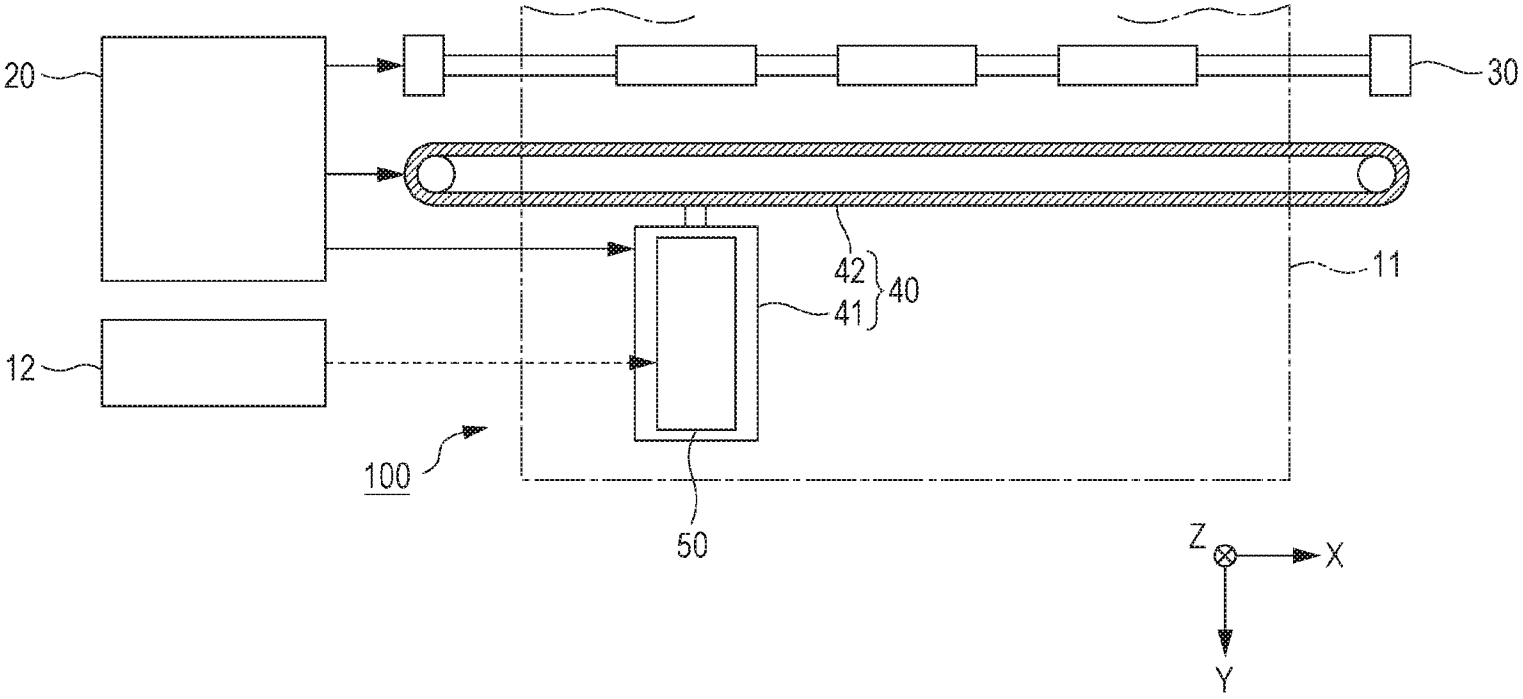
FIG. 1 is a block diagram illustrating the configuration of a liquid ejecting apparatus according to a first embodiment.
Figure 2:
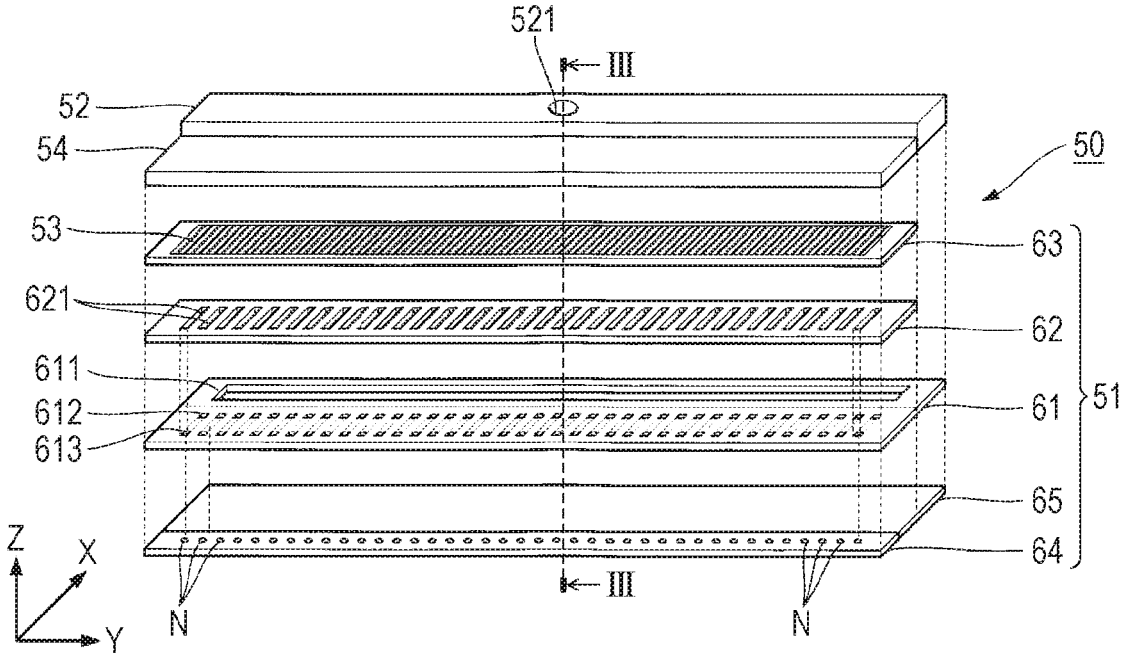
FIG. 2 is an exploded perspective view of a liquid ejection head.

As shown in FIGS. 1 and 2, the X axis, the Y axis, and the Z axis that are mutually orthogonal to each other are assumed in the following description. The X-Y plane including the X axis and the Y axis corresponds to the horizontal plane. The Z axis is an axis line along the vertical direction. Hereinafter, observing an object from the Z axis direction will be referred to as "plan view".

FIG. 1 is a partial configuration view of a liquid ejecting apparatus 100 according to the embodiment. The liquid ejecting apparatus 100 of the present embodiment is an ink jet printing apparatus that ejects ink droplets, which is an example of a liquid, onto a medium 11. The medium 11 is, for example, printing paper. However, a print target made of any material such as a resin film or fabric cloth may be used as the medium 11. The liquid ejecting apparatus 100 is provided with a liquid container 12. The liquid container 12 stores ink. For example, a cartridge that is attachable to and detachable from the liquid ejecting apparatus 100, a bag-shaped ink pack formed of a flexible film, or an ink tank that can be refilled with ink is used as the liquid container 12. Any number of types of the ink stored in the liquid container 12 may be provided.

As illustrated in FIG. 1, the liquid ejecting apparatus 100 includes a control unit 20, a transport mechanism 30, a movement mechanism 40, and a liquid ejection head 50. The control unit 20 controls respective elements of the liquid ejecting apparatus 100. The transport mechanism 30 transports the medium 11 in the Y axis direction under the control of the control unit 20.

The movement mechanism 40 reciprocates the liquid ejection head 50 along the X axis under the control of the control unit 20. The movement mechanism 40 of the present embodiment includes a substantially box-shaped transport body 41 that houses the liquid ejection head 50, and a transport belt 42 to which the transport body 41 is fixed. A configuration in which a plurality of the liquid ejection heads 50 is mounted on the transport body 41, or a configuration in which the liquid container 12 together with the liquid ejection heads 50 is mounted on the transport body 41 may be adopted.

The liquid ejection head 50 ejects the ink supplied from the liquid container 12 from each of a plurality of nozzles N onto the medium 11 under the control of the control unit 20. The liquid ejection head 50 ejects the ink onto the medium 11 in parallel with the transport of the medium 11 by the transport mechanism 30 and the repeated reciprocal movement of the transport body 41, so that an image is formed on the surface of the medium 11.

Figure 3:
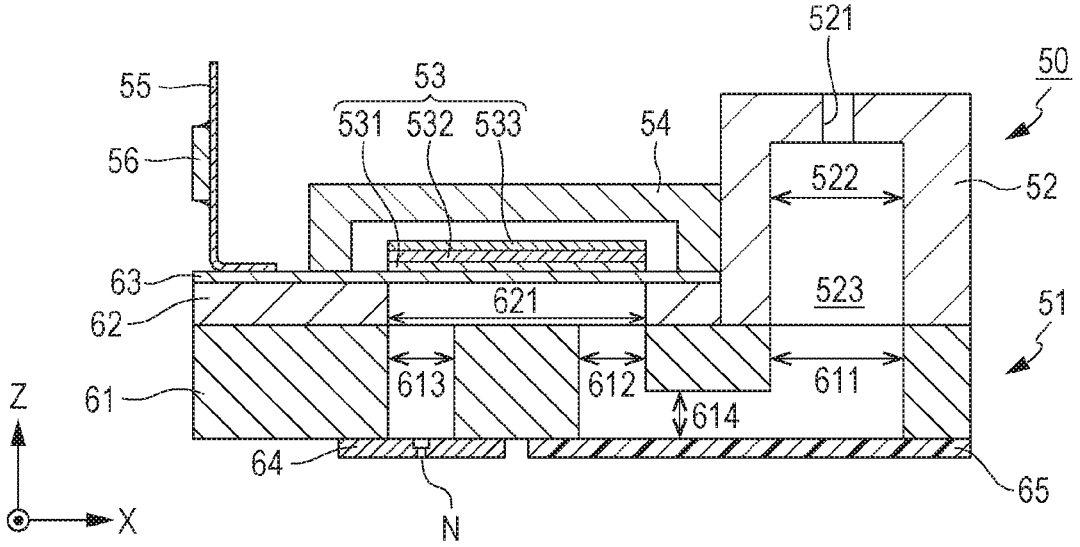
FIG. 3 is a sectional view taken along line III-III in FIG. 2.

FIG. 2 is an exploded perspective view of the liquid ejection head 50, and FIG. 3 is a sectional view taken along line III-III in FIG. 2. As illustrated in FIGS. 2 and 3, the liquid ejection head 50 includes a plurality of nozzles N disposed along the Y axis.

The liquid ejection head 50 according to the present embodiment includes a flow path structure 51, a housing 52, a plurality of piezoelectric elements 53, a sealing body 54, and a wiring substrate 55. In FIG. 2, the wiring substrate 55 is not shown for convenience. The flow path structure 51 is a structure in which a flow path through which the ink is supplied to the plurality of nozzles N is formed therein. The flow path structure 51 of the present embodiment includes a first substrate 61, a second substrate 62, a diaphragm 63, a nozzle plate 64, and a vibration absorber 65. Each member constituting the flow path structure 51 is an elongated plate-like member along the Y axis, and is fixed to each other with, for example, an adhesive. The nozzle plate 64 and the vibration absorber 65 are joined to the surface of the first substrate 61 in the negative Z axis direction, the second substrate 62 and the diaphragm 63 are laminated on the surface of the first substrate 61 in the positive Z axis direction.

Figure 4:
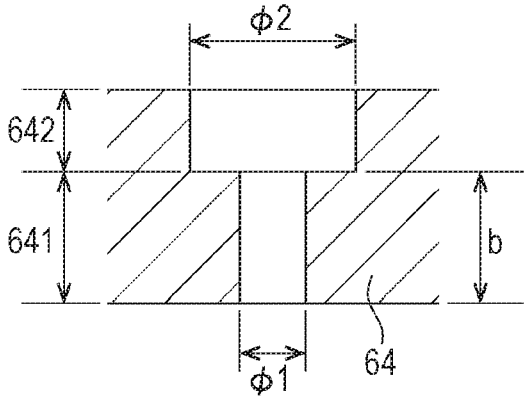
FIG. 4 is a sectional view of a nozzle.

The nozzle plate 64 is provided with the plurality of nozzles N. Each nozzle N is a circular through hole through which the ink is ejected. FIG. 4 is an enlarged sectional view of one nozzle N. As illustrated in FIG. 4, the nozzle N includes a first section 641 and a second section 642 coupled to each other. The first section 641 is located in the negative Z axis direction with respect to the second section 642. Each of the first section 641 and the second section 642 is a cylindrical space. The inner diameter φ2 of the second section 642 is greater than the inner diameter φ1 of the first section 641. The first section 641 is a section having the smallest inner diameter in the axial direction of the nozzle N. Hereinafter, the total length of the first section 641 will be referred to as a "nozzle length b".

As illustrated in FIGS. 2 and 3, the first substrate 61 has a space 611, a plurality of supply flow paths 612, a plurality of communication flow paths 613, and a relay flow path 614. The space 611 is an elongated opening along the Y axis in plan view. The supply flow path 612 and the communication flow path 613 are through holes formed for each nozzle N. The relay flow path 614 is an elongated space along the Y axis over the plurality of nozzles N, and communicates the space 611 and the plurality of supply flow paths 612 to each other. Each of the plurality of communication flow paths 613 overlaps with one nozzle N corresponding to the communication flow path 613 in plan view.

As illustrated in FIGS. 2 and 3, the second substrate 62 has a plurality of pressure chambers 621. The pressure chamber 621 is formed for each nozzle N. Each pressure chamber 621 is an elongated space along the X axis in plan view. The plurality of pressure chambers 621 is disposed along the Y axis.

An elastically deformable diaphragm 63 is laminated on the second substrate 62. The second substrate 62 is located between the first substrate 61 and the diaphragm 63. The pressure chamber 621 is a space located between the first substrate 61 and the diaphragm 63. That is, the diaphragm 63 constitutes the wall surface of each pressure chamber 621. As illustrated in FIG. 3, the pressure chamber 621 communicates with the communication flow path 613 and the supply flow path 612. Therefore, the pressure chamber 621 communicates with the nozzle N via the communication flow path 613.

The housing 52 is a case that stores the ink supplied to the plurality of pressure chambers 621, and is formed by ejection molding of a resin material, for example. The housing 52 has a supply port 521 and a space 522. The supply port 521 is a conduit through which the ink is supplied from the liquid container 12, and communicates with the space 522. As illustrated in FIG. 3, the space 611 of the first substrate 61 and the space 522 of the housing 52 communicate with each other. The space formed by the space 611 and the space 522 functions as a liquid storage chamber 523 that stores the ink supplied to the plurality of pressure chambers 621. The ink supplied from the liquid container 12 and passed through the supply port 521 is stored in the liquid storage chamber 523. The ink stored in the liquid storage chamber 523 is supplied in parallel to the plurality of pressure chambers 621 through the supply flow paths 612 branching off from the relay flow path 614. The vibration absorber 65 is a flexible film that forms the wall surface of the liquid storage chamber 523, and absorbs a change in a pressure of the ink in the liquid storage chamber 523.

As illustrated in FIGS. 2 and 3, the plurality of piezoelectric elements 53 is formed on the surface, of the diaphragm 63, opposite to the pressure chamber 621. The piezoelectric element 53 is an elongated passive element along the X axis in plan view. The plurality of piezoelectric elements 53 is disposed along the Y axis. As illustrated in FIG. 3, the piezoelectric element 53 has a structure in which a first electrode 531, a piezoelectric body layer 532, and a second electrode 533 are laminated in the Z axis direction. The piezoelectric layer body 532 is located between the first electrode 531 and the second electrode 533. The first electrode 531 is a common electrode that is continuous over the plurality of piezoelectric elements 53, and the second electrode 533 is an individual electrode that is individually formed for each piezoelectric element 53. The first electrode 531 is set to a predetermined reference potential Vbs. Note that the first electrode 531 may be a common electrode and the second electrode 533 may be an individual electrode.

Each piezoelectric element 53 is deformed according to the voltage applied between the first electrode 531 and the second electrode 533 to change the pressure of the ink in the pressure chamber 621. The ink in the pressure chamber 621 is ejected from the nozzle N when the piezoelectric element 53 changes the pressure of the ink in the pressure chamber 621. The sealing body 54 is a structure that protects the plurality of piezoelectric elements 53.

The wiring substrate 55 is a mounting component at which a plurality of wirings (not shown) that electrically couples the control unit 20 and the liquid ejection head 50 is formed. For example, the flexible wiring substrate 55 such as a flexible printed circuit (FPC) or a flexible flat cable (FFC) is preferably adopted. A drive circuit 56 that drives each of the plurality of piezoelectric elements 53 is mounted on the wiring substrate 55.

Figure 5:
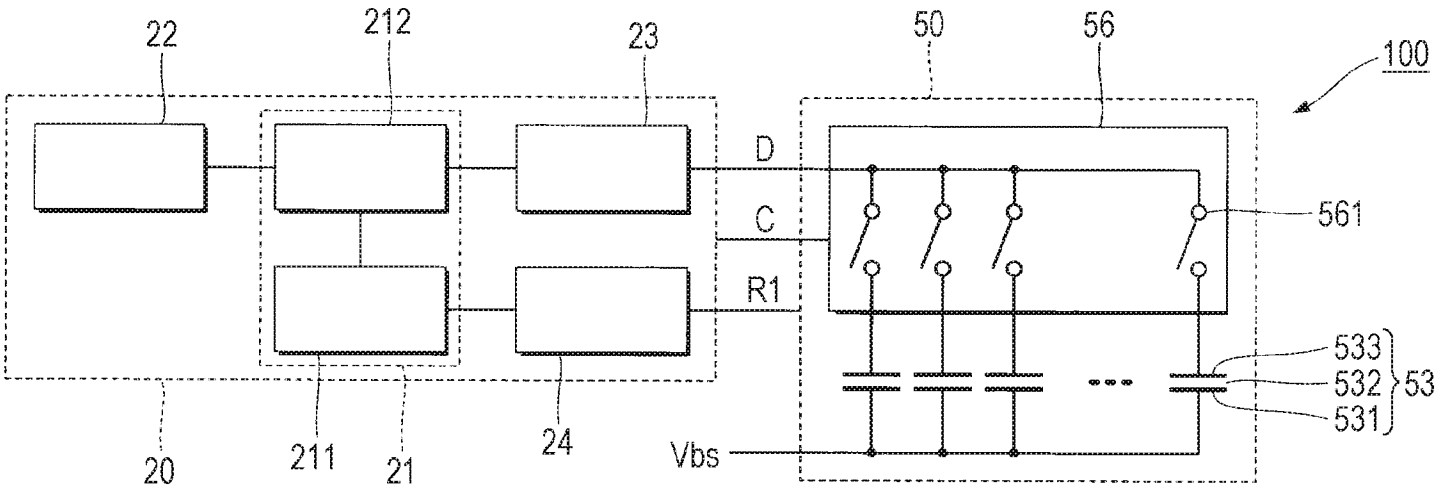
FIG. 5 is a block diagram illustrating a functional configuration of the liquid ejecting apparatus.

FIG. 5 is a block diagram illustrating a functional configuration of the liquid ejecting apparatus 100. The illustrations of the transport mechanism 30 and the movement mechanism 40 are omitted for convenience. The control unit 20 supplies a control signal C and a drive signal D to the drive circuit 56. The control signal C is a signal for instructing the presence/absence of the ink ejection for each of the plurality of nozzles N every predetermined cycle U. The drive signal D is a voltage signal whose voltage changes every predetermined cycle. As illustrated in FIG. 5, the drive circuit 56 includes a plurality of switches 561 corresponding to different piezoelectric elements 53. Each switch 561 is composed of, for example, a transfer gate that switches supply/stop of the drive signal D to the piezoelectric element 53.

Figure 6:
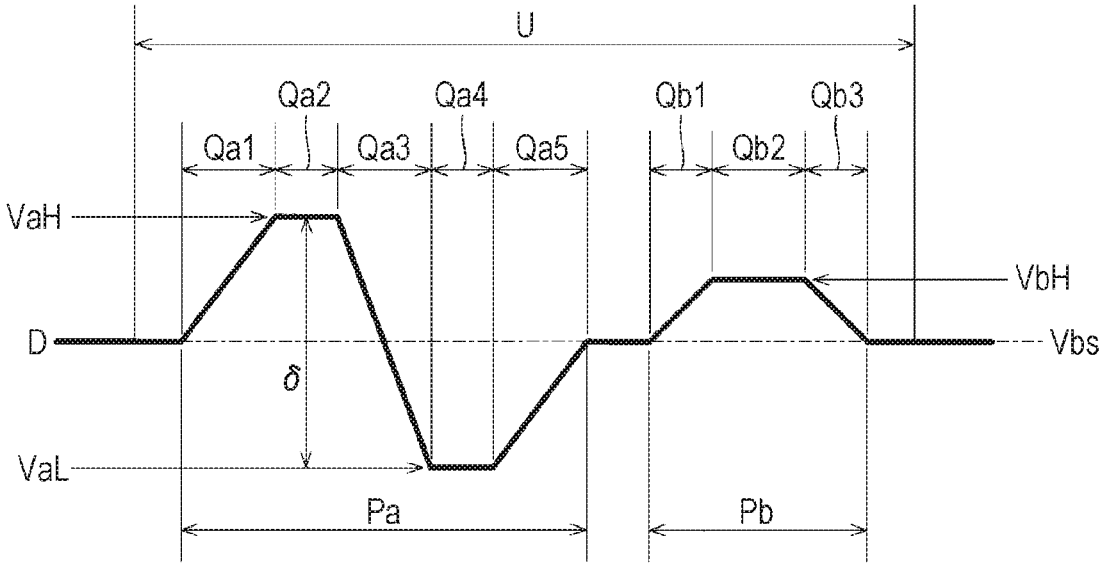
FIG. 6 is a waveform diagram of a drive signal.

FIG. 6 is a waveform diagram of the drive signal D. As illustrated in FIG. 6, the drive signal D of the present embodiment includes an ejection pulse Pa and a micro-vibration pulse Pb for each cycle U.

The ejection pulse Pa is a waveform for driving the piezoelectric element 53 by the inverse piezoelectric effect so that the ink is ejected from the nozzle N. Specifically, the ejection pulse Pa includes a section Qa1, a section Qa2, a section Qa3, a section Qa4, and a section Qa5. The section Qa1 is a section in which the potential rises from the predetermined reference potential Vbs to a higher potential VaH. The section Qa2 subsequent to the section Qa1 is a section in which the potential of the drive signal D is maintained at the potential VaH. The section Qa3 subsequent to the section Qa2 is a section in which the potential of the drive signal D decreases from the high potential VaH to a low potential VaL below the reference potential Vbs. The section Qa4 subsequent to the section Qa3 is a section in which the potential of the drive signal D is maintained at the potential VaL. The section Qa5 subsequent to the section Qa4 is a section in which the potential of the drive signal D rises from the potential VaL to the reference potential Vbs. The pressure chamber 621 expands due to the change in potential in the section Qa1. Further, the pressure chamber 621 contracts due to the change in the potential in the section Qa3, so that the ink is ejected from the nozzle N. That is, when the piezoelectric element 53 is deformed by a supply of the ejection pulse Pa, the ink is ejected from the nozzle N corresponding to the piezoelectric element 53. The waveform of the ejection pulse Pa is not limited to the example shown in FIG. 6.

The micro-vibration pulse Pb is a waveform that micro-vibrates the ink in the pressure chamber 621 to the extent that the ink is not ejected from the nozzle N. In particular, the micro-vibration pulse Pb includes a section Qb1, a section Qb2 and a section Qb3. The section Qb1 is a section in which the potential rises from the predetermined reference potential Vbs to a higher potential VbH. The potential VbH is less than the potential VaH in the ejection pulse Pa. The section Qb2 subsequent to the section Qb1 is a section in which the potential of the drive signal D is maintained at the potential VbH. The section Qb3 subsequent to the section Qb2 is a section in which the potential of the drive signal D decreases from the potential VbH to the reference potential Vbs. When the piezoelectric element 53 is deformed by a supply of the micro-vibration pulse Pb, a micro-vibration of the ink in the pressure chamber 621 corresponding to the piezoelectric element 53 is generated. The micro-vibration pulse Pb is also referred to as a waveform that vibrates the meniscus of the ink in the nozzle N. The waveform of the micro-vibration pulse Pb is not limited to the example shown in FIG. 6.

In the operation of ejecting the ink onto the surface of the medium 11 (hereinafter referred to as a "printing operation"), the drive circuit 56 supplies the ejection pulse Pa to the piezoelectric element 53 corresponding to the nozzle N which is instructed by the control signal C to perform the ejection of the ink. On the other hand, the drive circuit 56 supplies the micro-vibration pulse Pb to the piezoelectric element 53 which is instructed by the control signal C to perform the no-ejection of the ink.

Due to various causes such as evaporation of water or the like of the solvent of the ink from the meniscus in the nozzle N, the characteristics of the ink in each nozzle N change with time. In consideration of the above circumstances, the liquid ejecting apparatus 100 according to the present embodiment controls the waveform of the ejection pulse Pa according to the characteristics of the ink in the nozzle N.

As illustrated in FIG. 5, the control unit 20 includes a control device 21, a storage device 22, a signal generation circuit 23, and a vibration detection circuit 24. The control device 21 is a single processor or a plurality of processors that executes various calculations and control. Specifically, the control device 21 is configured by one or more types of processor such as a central processing unit (CPU), a graphics processing unit (GPU), a digital signal processor (DSP), or a field programmable gate array (FPGA). The storage device 22 is a single memory or a plurality of memories that stores a program executed by the control device 21 and various pieces of data used by the control device 21. For example, a known recording medium such as a semiconductor recording medium and a magnetic recording medium, or a combination of a plurality of types of recording media is optionally adopted as the storage device 22.

The signal generation circuit 23 generates the drive signal D according to an instruction from the control device 21. The drive signal D generated by the signal generation circuit 23 together with the control signal C generated by the control device 21 is supplied to the drive circuit 56.

The vibration detection circuit 24 detects a residual vibration V for each of the plurality of pressure chambers 621. The residual vibration V is a fluctuation in the pressure remaining in the ink in the pressure chamber 621 after the signal is supplied to the piezoelectric element 53. The vibration detection circuit 24 generates an electromotive force generated by the piezoelectric effect in the piezoelectric element 53 when, for example, the residual vibration V in each pressure chamber 621 propagates to the piezoelectric element 53, as a detection signal R1 representing the waveform of the residual vibration V. That is, the detection signal R1 is a voltage signal representing the waveform of the residual vibration V.

Figure 7:
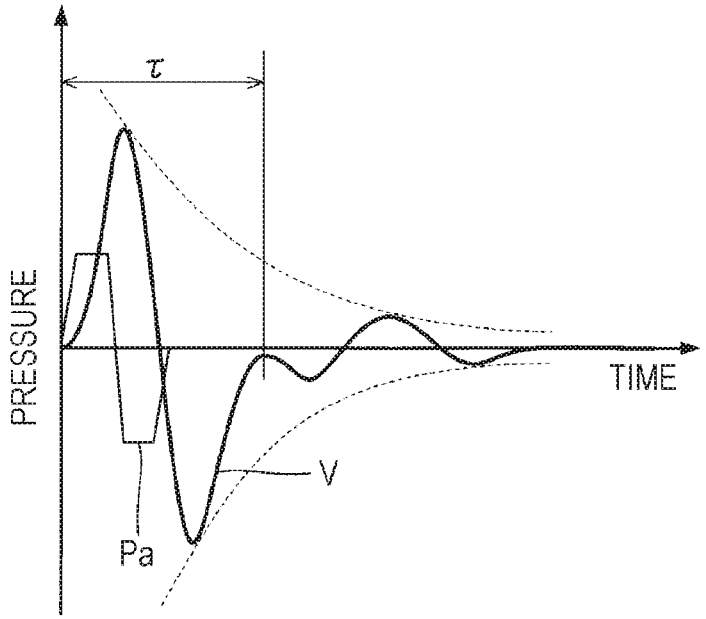
FIG. 7 is a graph showing a relationship between an ejection pulse and a residual vibration.

FIG. 7 is a graph showing the relationship between the ejection pulse Pa and the residual vibration V. The start point of the ejection pulse Pa is the origin of the time axis. Further, in FIG. 7, the decay curve is also shown by a broken line. As understood from FIG. 7, the residual vibration V generated by the ejection pulse Pa is a waveform that periodically changes while being attenuated with time. Therefore, for the residual vibration V, an attenuation factor β and a cycle τ are calculated. The attenuation factor β is an index of the degree to which the amplitude value of the residual vibration V decreases per unit time. The cycle τ is, for example, the time length of one wavelength from the start point of the ejection pulse Pa.

As illustrated in FIG. 5, the control device 21 functions as a specifying unit 211 and a controller 212 by executing the program stored in the storage device 22. The specifying unit 211 and the controller 212 are elements for controlling the waveform of the ejection pulse Pa according to the characteristics of the ink.

The specifying unit 211 specifies the characteristics of the ink in the nozzle N. There is a tendency that the characteristics of the ink in the nozzle N correlate with the characteristics of the residual vibration V generated in the pressure chamber 621. Against the background of the above tendency, the specifying unit 211 of the present embodiment specifies the characteristics of the ink in the nozzle from the residual vibration V detected by the vibration detection circuit 24. Specifically, the specifying unit 211 analyzes the detection signal R1 generated by the vibration detection circuit 24 to specify a viscosity η and a surface tension γ of the ink. The viscosity η is an index relating to the degree of a viscosity of the ink. The surface tension γ is an index relating to the magnitude of a tension acting along the surface of the ink.

The controller 212 controls the waveform of the ejection pulse Pa according to the characteristics of the ink specified by the specifying unit 211. Specifically, the controller 212 controls an amplitude value δ of the ejection pulse Pa according to the viscosity η and the surface tension γ specified by the specifying unit 211. As illustrated in FIG. 6, the amplitude value δ corresponds to the difference between the high potential VaH and the low potential VaL in the ejection pulse Pa. The controller 212 controls the amplitude value δ by adjusting one or both of the high potential VaH and the low potential VaL. There is a tendency that the larger the amplitude value δ, the larger the pressure generated in the pressure chamber 621.

Figure 8:
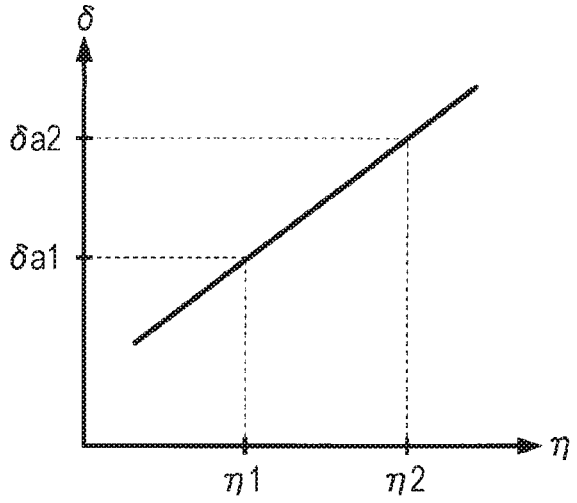
FIG. 8 is a graph showing a relationship between an ink viscosity and an amplitude value of an ejection pulse.

FIG. 8 is a graph showing the relationship between the viscosity η and the amplitude value δ. In FIG. 8, it is assumed that the surface tension γ is kept constant. As illustrated in FIG. 8, the controller 212 sets the amplitude value δ to a larger numerical value as the viscosity η increases. For example, attention is paid to a numerical value η1 and a numerical value η2 with respect to the viscosity η. The numerical value η2 is greater than the numerical value η1. As understood from FIG. 8, an amplitude value δa1 when the viscosity η is the numerical value η1 is less than an amplitude value δa2 when the viscosity η is the numerical value η2.

The relationship between the viscosity η and the amplitude value δ is not limited to the example shown in FIG. 8. For example, although the amplitude value δ is linearly changed with respect to the viscosity η in FIG. 8, the amplitude value δ may be changed in a curve with respect to the viscosity η. Further, although the amplitude value δ is continuously changed with respect to the viscosity η in FIG. 8, the amplitude value δ may be changed stepwise with respect to the viscosity η. That is, there may be a range in which the amplitude value δ does not change with respect to the change in the viscosity η. The numerical value η1 is an example of the "fifth value" and the numerical value η2 is an example of the "sixth value".

Figure 9:
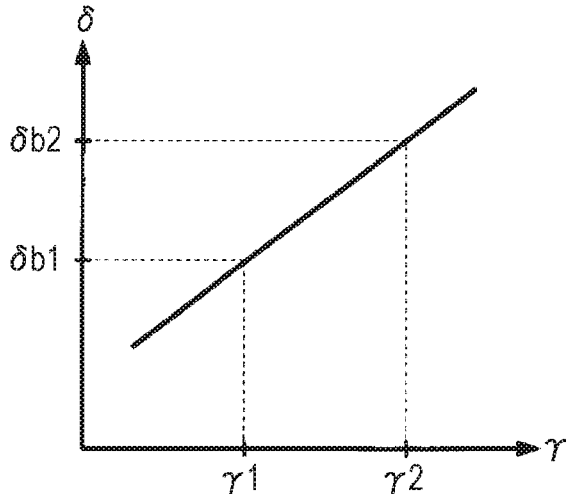
FIG. 9 is a graph showing a relationship between a surface tension and an amplitude value of an ejection pulse.

FIG. 9 is a graph showing the relationship between the surface tension γ and the amplitude value δ. In FIG. 9, it is assumed that the viscosity η is kept constant. As illustrated in FIG. 9, the controller 212 sets the amplitude value δ to a larger numerical value as the surface tension γ increases. For example, attention is paid to a numerical value γ1 and a numerical value γ2 with respect to the surface tension γ. The numerical value γ2 is greater than the numerical value γ1. As understood from FIG. 9, an amplitude value δb1 when the surface tension γ is the numerical value γ1 is less than an amplitude value δb2 when the surface tension γ is the numerical value γ2.

The relationship between the surface tension γ and the amplitude value δ is not limited to the example shown in FIG. 9. For example, although the amplitude value δ is linearly changed with respect to the surface tension γ in FIG. 9, the amplitude value δ may be changed in a curve with respect to the surface tension γ. Further, although the amplitude value δ is continuously changed with respect to the surface tension γ in FIG. 9, the amplitude value δ may be changed stepwise with respect to the surface tension γ. That is, there may be a range in which the amplitude value δ does not change with respect to the change in the surface tension γ. The numerical value γ1 is an example of the "seventh value", and the numerical value γ2 is an example of the "eighth value".

Specifically, the storage device 22 stores a table in which respective combinations of the numerical value of the viscosity η and the numerical value of the surface tension γ, and respective numerical values of the amplitude value δ are associated with each other. The relationship of FIG. 8 is established between the respective numerical values of the viscosity η and the respective numerical values of the amplitude value δ, and the relationship of FIG. 9 is established between the respective numerical values of the surface tension γ and the respective numerical values of the amplitude value δ. The controller 212 searches the table for a numerical value combination of the viscosity η and the surface tension γ identified by the specifying unit 211 to determine the amplitude value δ corresponding to the combination as the amplitude value of the ejection pulse Pa.

Figure 10:
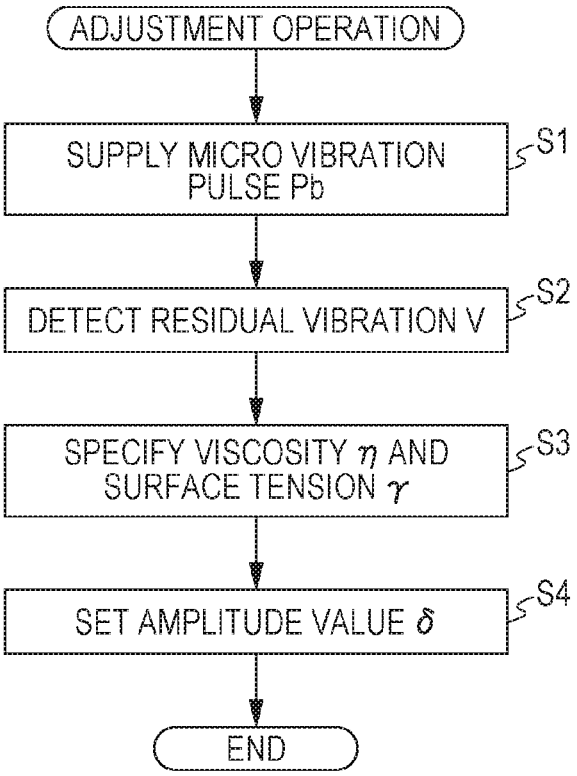
FIG. 10 is a flowchart illustrating a specific procedure of an adjustment operation.

FIG. 10 is a flowchart exemplifying a specific procedure of a process in which the liquid ejecting apparatus 100 controls the waveform of the ejection pulse Pa (hereinafter, referred to as an "adjustment operation"). The adjustment operation of FIG. 10 is performed before the start of the printing operation. In the printing operation, the ejection pulse Pa having the amplitude value δ set by the adjustment operation is used.

When the adjustment operation is started, the control device 21 controls the drive circuit 56 to supply the micro-vibration pulse Pb to each of the plurality of piezoelectric elements 53 (S1). After the micro-vibration pulse Pb is supplied to the piezoelectric element 53, the residual vibration V is generated in each pressure chamber 621. The residual vibration V may be generated in each pressure chamber 621 by supplying the ejection pulse Pa.

The vibration detection circuit 24 generates the detection signal R1 representing the waveform of the residual vibration V generated in each pressure chamber 621 (S2). The specifying unit 211 specifies the viscosity η and the surface tension γ from the detection signal R1 (S3). For example, the specifying unit 211 firstly specifies the viscosity η and the surface tension γ from the detection signal R1 for each pressure chamber 621. Secondly, the specifying unit 211 calculates a representative value (for example, an average value) of the viscosities η in the plurality of pressure chambers 621 as the final viscosity η, and calculates a representative value (for example, an average value) of the surface tensions γ in the plurality of pressure chambers 621 as the final surface tension γ.

The controller 212 sets the amplitude value δ of the ejection pulse Pa according to the viscosity η and the surface tension γ specified by the specifying unit 211 (S4). In the printing operation after executing the adjustment operation described above, the signal generation circuit 23 generates the drive signal D including the ejection pulse Pa having the amplitude value δ set by the controller 212.

As understood from the above description, in the present embodiment, the waveform of the ejection pulse Pa is controlled according to the viscosity η and the surface tension γ of the ink in the nozzle N. Therefore, even when the characteristics of the ink in the nozzle N change, the error relating to the ink ejection characteristics can be reduced. The ejection characteristic is, for example, an ejection amount, an ejection speed or an ejection direction. In addition, it is possible to optimize the shape of the ink droplet such as the amount of tailing and to suppress the mist.

As described above, in this embodiment, it is possible to measure the physical properties of the ink (viscosity η and surface tension γ) at the meniscus for each nozzle N of the liquid ejection head 50. In a nozzle row in which a plurality of nozzles N is disposed, there is a tendency that the meniscus of the peripheral nozzle N tends to dry easily, compared to that of the central nozzle N, due to a difference in the environment such as a humidity or a temperature. That is, it can be said that the viscosity η of the ink in the peripheral nozzle N of the nozzle row tends to increase. According to this embodiment, since the nozzle N having the increased ink viscosity η is identified, it is possible to make the ink ejection speed uniform for the entire nozzle row by increasing the ink ejection pressure in the identified nozzle N. Therefore, it is possible to perform uniform printing.

Figure 11:
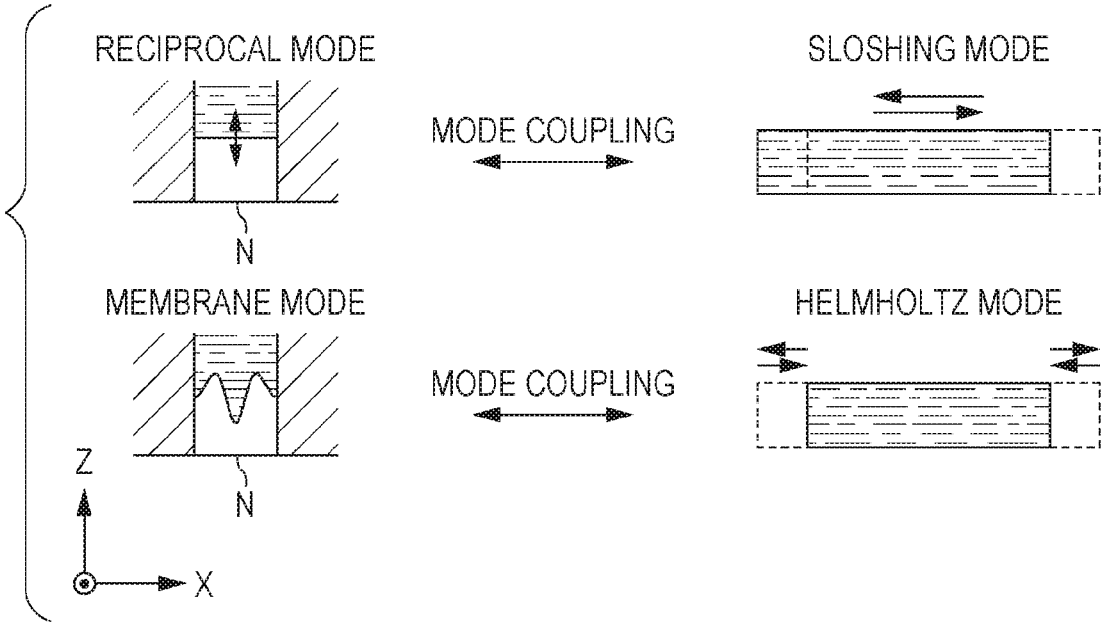
FIG. 11 is an explanatory diagram of a vibration of a meniscus and a vibration of ink in a pressure chamber.

FIG. 11 is an explanatory diagram relating to the vibration of the ink meniscus in the nozzle N illustrated in FIG. 3 and the vibration of the ink in the pressure chamber 621. As illustrated in FIG. 11, the vibration of the meniscus in the nozzle N includes a reciprocation mode (Reciprocal mode) component and a membrane vibration mode (Membrane mode) component. The reciprocation mode is a vibration mode in which the meniscus reciprocates along the Z axis. The membrane vibration mode is a vibration mode in which the surface of the meniscus undulates. The membrane vibration mode is a circular membrane vibration mode in which the amount of vibration is zero on the node line and the concentric circle line according to the vibration order.

On the other hand, the vibration of the ink in the pressure chamber 621 includes a swing mode (sloshing mode) component and a expansion/contraction mode (Helmholtz mode) component. The swing mode is a vibration mode in which the ink in the pressure chamber 621 reciprocates along the X axis. The expansion/contraction mode is a vibration mode in which the ink in the pressure chamber 621 expands/contracts along the X axis. The expansion/contraction mode is dominant in the residual vibration V generated in the pressure chamber 621. From the viewpoint of making the expansion/contraction mode dominant, it is desirable to suppress the propagation of vibration from the pressure chamber 621 and the supply flow path 612 to the space 611.

There is a tendency that as illustrated in FIG. 11, the meniscus reciprocation mode is coupled to the swing mode in the pressure chamber 621, and the membrane vibration mode of the meniscus is coupled to the expansion/contraction mode in the pressure chamber 621. The coupled vibration of the (0, 2) membrane vibration mode and the expansion/contraction mode directly contributes to the ejection of the ink from the nozzle N. The membrane vibration mode of (0, 2) is a vibration mode in which no node line exists on the meniscus and the amount of vibration is zero on one concentric line. The natural frequency in the membrane vibration mode of (0, 2) is 110 kHz. On the other hand, the natural frequency of the coupled vibration of the reciprocation mode and the swing mode is about 12 kHz. Considering the above circumstances, the specifying unit 211 of the present embodiment analyzes the vibration component in the frequency band (hereinafter referred to as an "analysis band") located above 20 kHz in the residual vibration V to specify the viscosity η and the surface tension γ. That is, the component of the coupled vibration of the reciprocation mode and the swing mode in the residual vibration V is not used for specifying the viscosity η and the surface tension γ. The analysis band is a frequency band, with a predetermined width, including 110 kHz, which is the natural frequency of the membrane vibration mode of (0, 2), and having a lower endpoint value of 20 kHz or more.

Figures 12, 13:
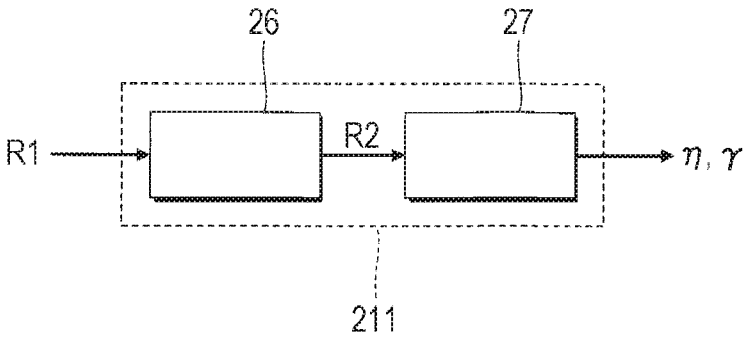
FIG. 12 is a block diagram illustrating a specific configuration of a specifying unit.
FIG. 13 shows the meaning of respective symbols in Expression (1) and typical numerical values.

FIG. 12 is a block diagram illustrating a specific configuration of the specifying unit 211. As illustrated in FIG. 12, the specifying unit 211 of the present embodiment includes a band limiting unit 26 and an analysis processing unit 27. The band limiting unit 26 is a bandpass filter that generates a detection signal R2 by removing components other than the analysis band from the detection signal R1 generated by the vibration detection circuit 24. That is, the vibration component of the coupled vibration of the reciprocation mode and the swing mode is removed from the detection signal R1. As can be understood from the above description, the band limiting unit 26 generates the detection signal R2 representing the waveform of the coupled vibration of the (0, 2) membrane vibration mode and the expansion/contraction mode. The analysis processing unit 27 estimates the viscosity η and the surface tension γ by analyzing the detection signal R2 that has processed by the band limiting unit 26. As illustrated above, in the present embodiment, the viscosity η and the surface tension γ are specified from the coupled vibration, of the (0, 2) membrane vibration mode and the expansion/contraction mode, that directly contributes to the ink ejection. Therefore, the viscosity η and the surface tension γ can be specified with high accuracy, compared with those obtained by the configuration in which the band limiting unit 26 is omitted.

The inventors of the present application have studied the formulation about the behavior of the ink ejected from the nozzle N. First, the inventors of the present application have carried out a perturbation expansion on the Navier-Stokes equation defining the motion of a fluid with respect to the vibration relating to the meniscus, which is the interface between a gas and a liquid. The basic analysis of the meniscus by perturbation theory is described in detail in Shuzo Hirahara, Haruyuki Minatani, "Effect of Aggregation of Pigment Ink Surface on Ink Jet Properties.", Proceedings of the Japan Society of Mechanical Engineers, 70-695 B (2004), pp. 75. The characteristic equation is derived by applying the boundary condition regarding the ink ejection in the liquid ejecting apparatus 100 to the solution of the perturbation equation derived by the perturbation expansion. The characteristic equation is a expression representing the relationship between a swing wavelength λ and a wave growth rate n. The swing wavelength λ is a wavelength of a wave motion (hereinafter, referred to as a "liquid surface swing") in which the meniscus in the nozzle N undulates in the membrane vibration mode. The wave growth rate n is a speed at which the liquid column of the ink projects from the meniscus due to the liquid surface swing. The ink ejection speed depends on the wave growth rate n. Specifically, the larger the wave growth rate n, the higher the ink ejection speed.

Specifically, the characteristic equation expressed by the following Expression (1) is derived. FIG. 13 shows the meaning of respective symbols in the expression and typical numerical values.

$$8(ka)^3\sqrt{(ka)^2+Sl}\,\{2(ka)^2+Sl\}\left\{1-\frac{1}{\cosh kb\cosh \zeta b}\right\}- 2\left\{(ka)^2(2(ka)^2+Sl)^2+4(ka)^4((ka)^2+Sl)\right\}\tanh \zeta b\tanh kb+ \left\{(ka)^2l^2h-\frac{\rho'}{\rho\tanh ka}(Sl)^2\right\} \left\{(2(ka)^2+Sl)\tanh \zeta b-2(ka)\sqrt{(ka)^2+Sl}\tanh kb\right\}=0 \quad (1)$$

Respective variables in Expression (1) are defined as follows.

$$\xi^2=k^2+\frac{\rho n}{\eta}$$

$$l^2=\frac{\rho a\gamma}{\eta^2}$$

$$S^2=\frac{\rho n^2a^3}{\gamma}$$

The symbol k in Expression (1) is the wave number of the liquid surface swing (hereinafter referred to as the "swing wave number"), and corresponds to the square root of the sum of the squares of the wave number kx in the X axis direction and the wave number ky in the Y axis direction, that is, $k^2=kx^2+ky^2$. The symbol a is the distance between the nozzle N and the surface of the medium 11. The symbol ka is a dimensionless wave number. The symbol S is a dimensionless wave growth rate and the symbol 1 is a dimensionless viscosity. The symbol b is a nozzle length as described above. The symbol ρ is a density of the ink, and the symbol ρ' is a density of the gas that contacts the meniscus.

By setting the element in the first parenthesis of the third term on the left side of Expression (1) to zero, the following Expression (2) expressing the relationship between the wave number k of the liquid surface swing and the dimensionless wave growth rate S is derived.

$$(ka)^2l^2h-\frac{\rho'}{\rho\tanh ka}(Sl)^2=0 \quad (2)$$

Expression (2) is a relational expression between the swing wave number k and the dimensionless wave growth rate S when the dimensionless viscosity l is set to infinity in Expression (1), that is, when the viscosity η is caused to approach zero.

When Expression (2) is modified by focusing on the relationship between the swing wave number k and the swing wavelength λ, that is, λ=2π/k, the following Expression (3) expressing the relationship between the wave growth rate n and the swing wavelength λ is derived. The symbol α in Expression (3) is a predetermined constant, and the symbol P is a ejection pressure.

$$n^2=\frac{2\pi\alpha}{\lambda}\left(\frac{P}{b\gamma}-\frac{4\pi^2}{\lambda^2}\right) \quad (3)$$

Figure 14:
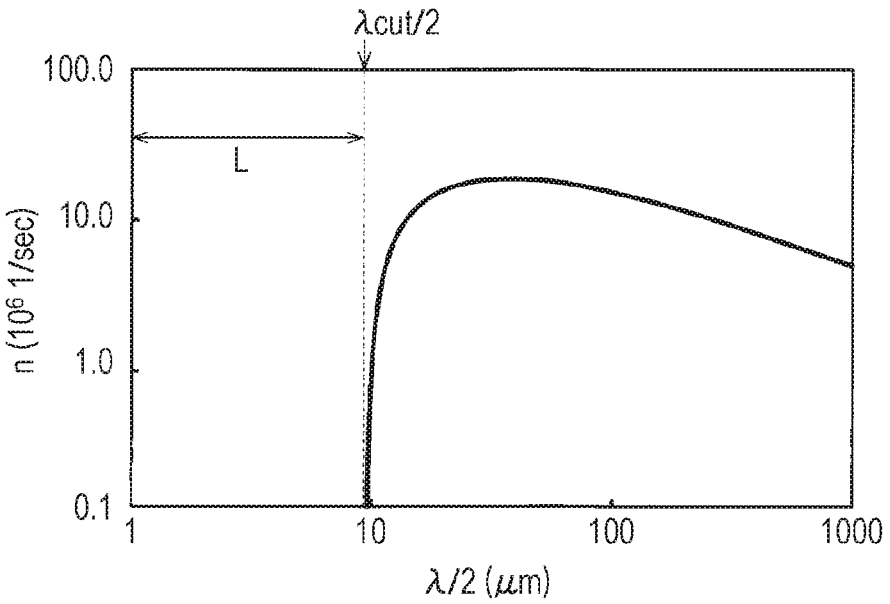
FIG. 14 is a graph showing a relationship between the dithering swing wavelength and the wave growth rate.

FIG. 14 is a graph showing the relationship between the half (λ/2) of the swing wavelength λ and the wave growth rate n. The relationship shown in FIG. 14 can be obtained by numerically solving Expression (1). The swing wavelength λ approaches a predetermined numerical value (hereinafter referred to as a "limit value") λcut. The limit value λcut of the swing wavelength λ is expressed by the following Expression (4) derived from Expression (3).

$$\lambda_{cut}=2\pi\sqrt{\frac{b\gamma}{P}} \quad (4)$$

As understood from Expression (4), the square of the limit value λcut is inversely proportional to the ejection pressure P, and is proportional to the nozzle length b and the surface tension γ.

As can be understood from FIG. 14, there is no solution of the characteristic equation of Expression (1) in the range L where the swing wavelength λ is less than the limit value λcut. That is, the meniscus wave does not grow in the range L. As can be understood from the above description, since no liquid column is generated in the meniscus when the inner diameter φ1 of the nozzle N is less than half (λcut/2) of the limit value λcut, no ink is ejected from the nozzle N. That is, the inner diameter φ1 is required to be greater than half of the limit value φcut expressed by Expression (4).

Figure 15:
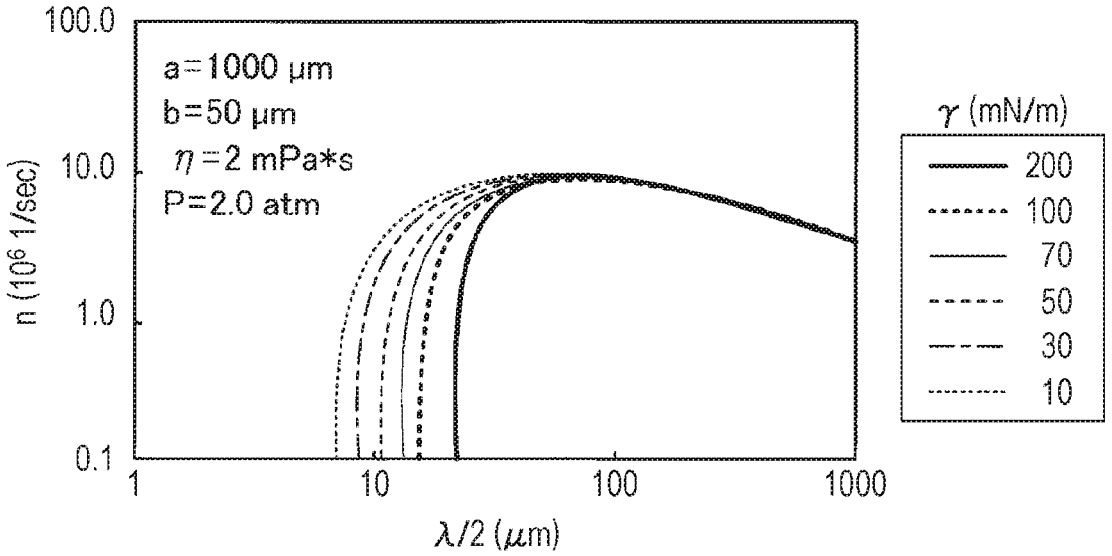
FIG. 15 is a graph showing a relationship between the swing wavelength, the wave growth rate, and the surface tension.

FIG. 15 is a graph showing the relationship between the half (λ/2) of the swing wavelength λ and the wave growth rate n in each of a plurality of cases where the surface tensions γ are different. The relationship of FIG. 15 can be obtained by numerically solving Expression (1). In FIG. 15, it is assumed that the viscosity η of the ink is constant. There is a tendency that as can be seen from FIG. 15, the larger the limit value λcut, the larger the surface tension γ. Therefore, the larger the surface tension γ of the ink, the larger the inner diameter φ1 of the nozzle N needs to be set.

Figure 16:
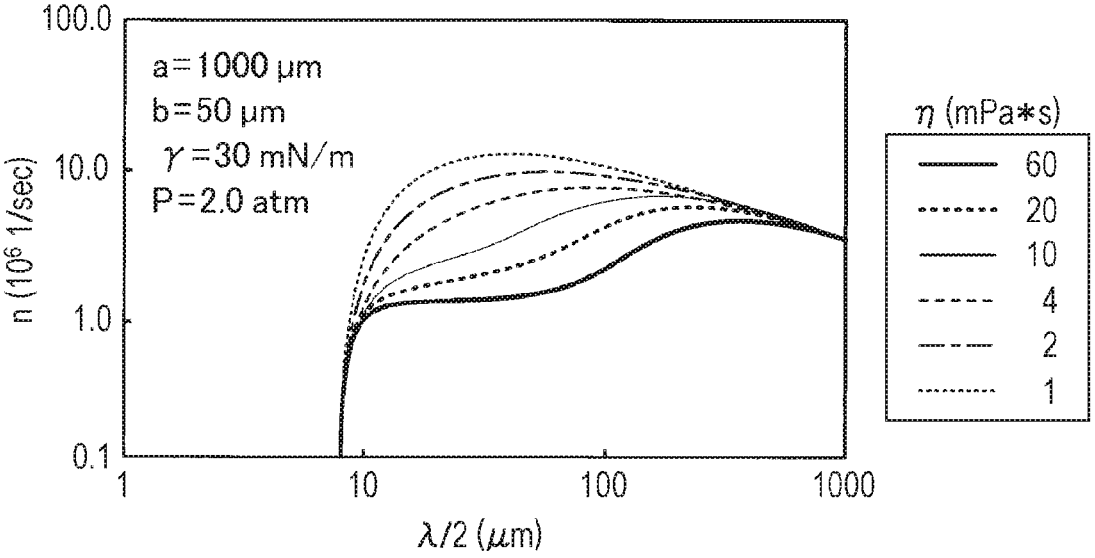
FIG. 16 is a graph showing a relationship between the swing wavelength, the wave growth rate, and the viscosity.

FIG. 16 is a graph showing the relationship between the half (λ/2) of the swing wavelength λ and the wave growth rate n for each of a plurality of cases where the respective viscosities η are different. The relationship of FIG. 16 is obtained by numerically solving Expression (1). In FIG. 16, it is assumed that the surface tension γ of the ink is constant. As can be understood from FIG. 16, the limit value λcut hardly depends on the viscosity η. However, there is a tendency that the higher the viscosity η, the smaller the numerical value of the peak of the wave growth rate n.

Figure 17:
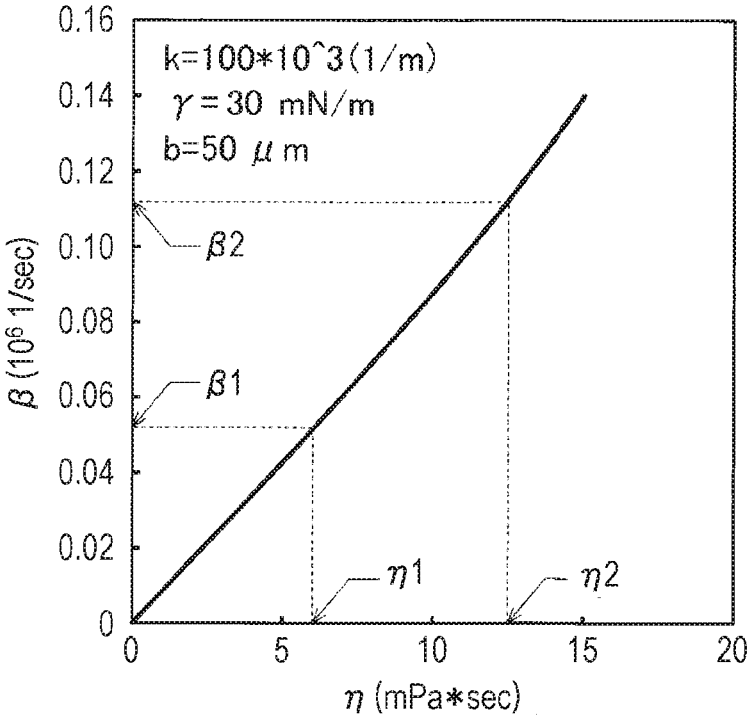
FIG. 17 is a graph showing a relationship between the viscosity of ink and the attenuation factor of the residual vibration.

FIG. 17 is a graph showing the relationship between the viscosity η of the ink and the attenuation factor β of the residual vibration V. The relationship of FIG. 17 is derived from the characteristic equation of Expression (1). As described above, the vibration of the expansion/contraction mode in the pressure chamber 621 is coupled to the vibration of the membrane vibration mode in the nozzle N. In the analysis band, the residual vibration V is dominated by the expansion/contraction mode, and the liquid surface swing is dominated by the membrane vibration mode. Therefore, the attenuation factor β of the residual vibration V corresponds to the wave growth rate n in Expression (1).

Figure 18:
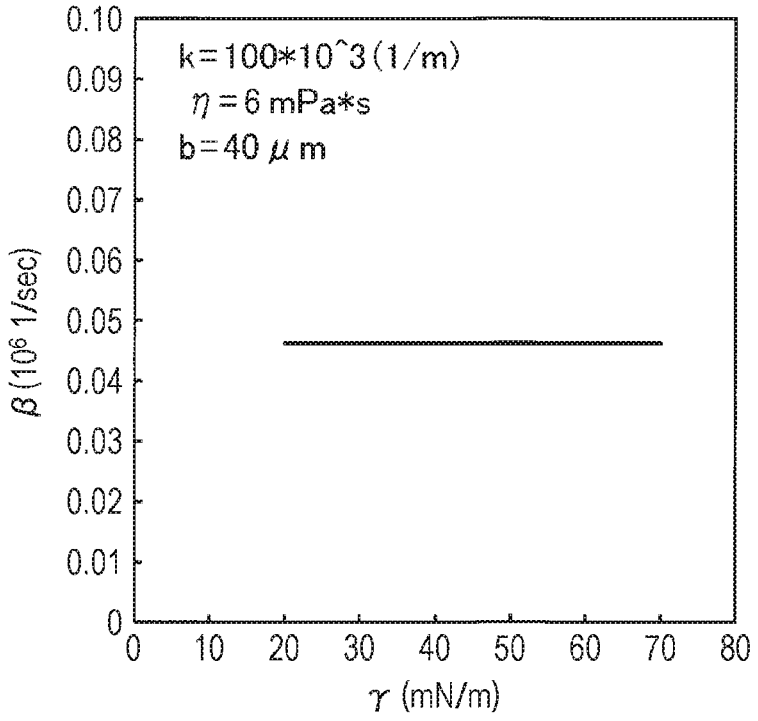
FIG. 18 is a graph showing a relationship between the surface tension of ink and the attenuation factor of the residual vibration.

As understood from FIG. 17, there is a correlation such that the attenuation factor β increases as the viscosity η increases. Specifically, the attenuation factor β monotonically increases with respect to the viscosity η. FIG. 18 is a graph showing the relationship between the surface tension γ of the ink and the attenuation factor β of the residual vibration V. As understood from FIG. 18, the attenuation factor β hardly depends on the surface tension γ. Using the above correlation, the specifying unit 211 specifies the viscosity η of the ink from the attenuation factor β of the residual vibration V. Specifically, the analysis processing unit 27 analyzes the detection signal R2 to calculate the attenuation factor β of the residual vibration V, and specifies the viscosity η from the attenuation factor β.

For example, attention is paid to a numerical value β1 and a numerical value β2 with respect to the attenuation factor β. The numerical value β2 is greater than the numerical value β1. As understood from FIG. 17, the viscosity η1 specified by the specifying unit 211 when the attenuation factor β is the numerical value β1 is less than the viscosity η2 specified by the specifying unit 211 when the attenuation factor β is the numerical value β2. The numerical value β1 is an example of the "first value", and the numerical value β2 is an example of the "second value".

In this embodiment, the storage device 22 stores a table in which the respective numerical values of the attenuation factor η and the respective numerical values of the viscosity η are associated with each other (hereinafter referred to as an "attenuation factor-viscosity table"). In the attenuation factor-viscosity table, the relationship of FIG. 17 is established between the respective numerical values of the attenuation factor β and the respective numerical values of the viscosity η. The specifying unit 211 calculates the attenuation factor β of the residual vibration V and specifies the viscosity η corresponding to the attenuation factor β in the attenuation factor-viscosity table. The specifying unit 211 may specify the viscosity η by calculation by substituting the attenuation factor β of the residual vibration V into an arithmetic expression that describes the relationship between the attenuation factor β and the viscosity η.

Figure 19:
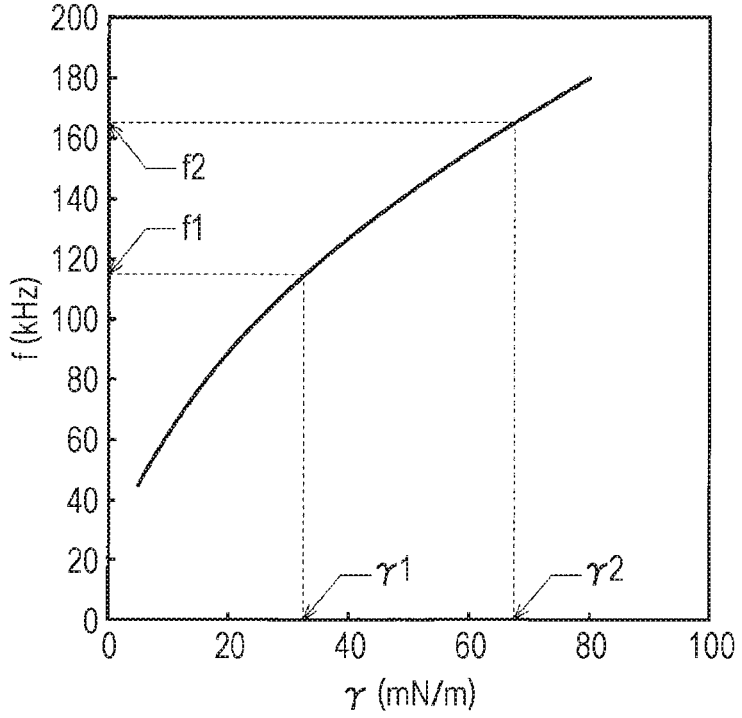
FIG. 19 is a graph showing a relationship between the surface tension of ink and the frequency of the residual vibration.

FIG. 19 is a graph showing the relationship between the surface tension γ of the ink and a frequency f of the residual vibration V. The frequency f is the reciprocal of the cycle τ of the residual vibration V described above with reference to FIG. 7. The membrane vibration in the meniscus, which is a circular membrane, is expressed by the F(02) mode of the Bessel function. The natural frequency F02 of the F(02) mode is expressed by the following Expression (5). The symbol r in Expression (5) is a radius of the nozzle N in the first section 641 (r=φ½), and the symbol σ is an ink mass per unit area in the nozzle N.

$$F02 = \frac{5.52}{\pi r}\sqrt{\frac{\gamma}{\sigma}} \tag{5}$$

As described above, the vibration of the expansion/contraction mode in the pressure chamber 621 is coupled to the vibration of the membrane vibration mode in the nozzle N. Therefore, the frequency f of the residual vibration V generated in the pressure chamber 621 corresponds to the natural frequency F02 of Expression (5). That is, the frequency f is proportional to the square root √γ of the surface tension γ, as can be understood from FIG. 19. Using the above correlation, the specifying unit 211 specifies the surface tension γ of the ink from the frequency f of the residual vibration V. Specifically, the analysis processing unit 27 analyzes the detection signal R2 to the frequency f of the residual vibration V, and specifies the surface tension γ from the frequency f.

For example, attention is paid to a numerical value f1 and a numerical value f2 with respect to the frequency f. The numerical value f2 is greater than the numerical value f1. As understood from FIG. 19, the surface tension γ1 specified by the specifying unit 211 when the frequency f is the numerical value f1 is less than the surface tension γ2 specified by the specifying unit 211 when the frequency f is the numerical value f2. The numerical value f1 is an example of the "third value", and the numerical value f2 is an example of the "fourth value".

In this embodiment, the storage device 22 stores a table in which the respective numerical values of the frequency f and the respective numerical values of the surface tension γ are associated with each other (hereinafter referred to as a "frequency-surface tension table"). In the frequency-surface tension table, the relationship of FIG. 19 is established between the respective numerical values of the frequency f and the respective numerical values of the surface tension γ. The specifying unit 211 calculates the frequency f of the residual vibration V to specify the surface tension γ corresponding to the frequency f in the frequency-surface tension table. The specifying unit 211 may specify the surface tension γ by calculation by substituting the frequency f of the residual vibration V into an arithmetic expression that describes the relationship between the frequency f and the surface tension γ.

Figure 20:
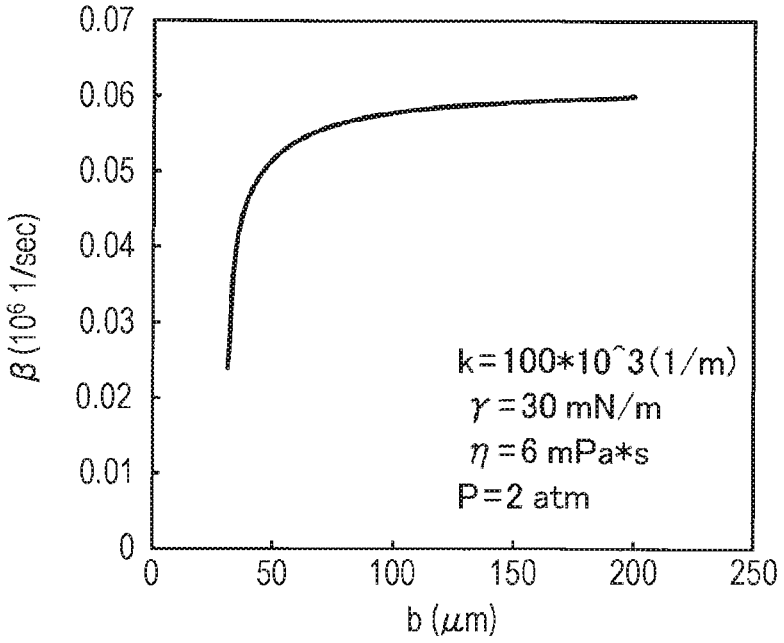
FIG. 20 is a graph showing a relationship between the nozzle length and the attenuation factor.

FIG. 20 is a graph showing the relationship between the nozzle length b and the attenuation factor β. The relationship of FIG. 20 is obtained by numerically solving Expression (1). As illustrated in FIG. 20, the correlation such that the wave growth rate n increases as the nozzle length b increases is understood from FIG. 20. Further, the attenuation factor β fluctuates excessively with respect to the error of the nozzle length b in the range where the nozzle length b is less than 30 μm. Therefore, the appropriate attenuation factor β cannot be stably specified. In consideration of the above circumstances, it is preferable that the nozzle length b is 30 μm or more, and more preferably the nozzle length b is set to 50 μm or more. According to the above configuration, there is an advantage that an appropriate attenuation factor β can be stably specified for the actual nozzle length b.

Figure 21:
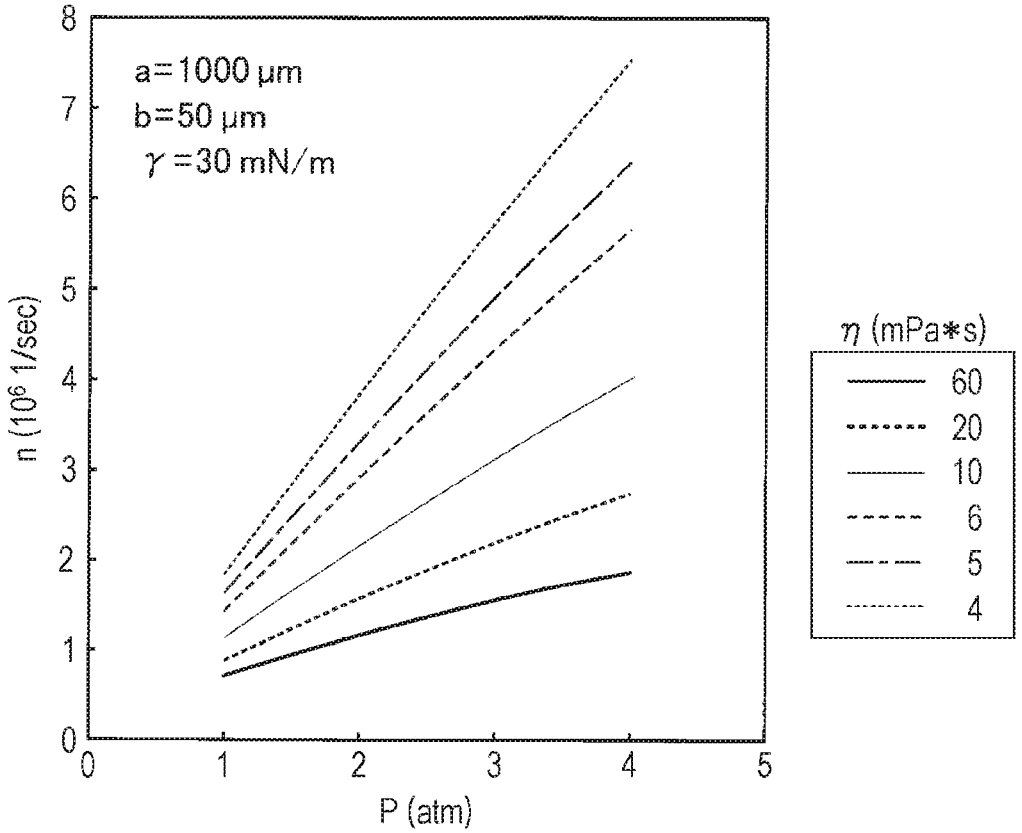
FIG. 21 is a graph showing a relationship between the ejection pressure, the wave growth rate, and the viscosity.

FIG. 21 is a graph showing the relationship between the ejection pressure P and the wave growth rate n. The relationship of FIG. 21 is obtained by numerically solving Expression (1). The relationship between the ejection pressure P and the wave growth rate n is shown for each of a plurality of cases in which the ink viscosities η are different. As understood from FIG. 21, there is a correlation such that the larger the ejection pressure P, the larger the wave growth rate n. Further, there is a tendency that the higher the viscosity η of the ink, the larger the ejection pressure P required to achieve the predetermined wave growth rate n. That is, in order to eject the ink at the target ejection speed, it is necessary to generate a larger pressure in the pressure chamber 621 as the viscosity η increases. The relationship between the viscosity η and the amplitude value δ described above with reference to FIG. 8 is a relationship determined against the background of the above tendency. That is, when the amplitude value δ of the ejection pulse Pa is set to a larger numerical value as the ink viscosity η increases, the ink can be ejected at a predetermined ejection speed regardless of whether the viscosity η is high or low.

B: Modification

The embodiments illustrated above may be variously modified. Specific aspects of modifications that can be applied to the above-described embodiment will be illustrated below. Two or more aspects optionally selected from the following exemplifications can be appropriately merged within a range not inconsistent with each other.

(1) In the above embodiment, although the residual vibration V when the micro-vibration pulse Pb is supplied to each of the plurality of piezoelectric elements 53 is detected from each pressure chamber 621, the residual vibration V when the micro-vibration pulse Pb is supplied to one piezoelectric element 53 may be detected to specify the viscosity η and the surface tension γ of the ink from the detected residual vibration V. That is, the operation of detecting the residual vibration V for the plurality of pressure chambers 621 is omitted.

(2) In the above embodiment, although the amplitude value δ of the ejection pulse Pa is controlled according to the viscosity η and the surface tension γ, the control target of the controller 212 is not limited to the amplitude value δ. For example, the controller 212 may control the time length of each of the sections Qa1 to Qa5 of the ejection pulse Pa or the rate of change in the potential in the ejection pulse Pa according to the viscosity η and the surface tension γ. As understood from the above examples, the controller 212 is comprehensively expressed as an element that controls the waveform of the ejection pulse Pa.

(3) In the above embodiment, although the drive signal D including one ejection pulse Pa and one micro-vibration pulse Pb is exemplified, the waveform of the drive signal D is not limited to the above example. The drive signal D including a plurality of ejection pulses Pa or the drive signal D including a plurality of micro-vibration pulses Pb may be used. In the configuration in which the drive signal D includes a plurality of ejection pulses Pa within the cycle U, one or more ejection pulses Pa of the plurality of ejection pulses Pa are controlled according to the viscosity η and the surface tension γ. Further, a plurality of drive signals D having different waveforms of the ejection pulse Pa may be selectively supplied to the piezoelectric element 53.

(4) The drive element that changes the pressure of the ink in the pressure chamber 621 is not limited to the piezoelectric element 53 illustrated in the above-described embodiment. For example, a heating element that fluctuates the pressure of the ink by generating air bubbles inside the pressure chamber 621 by heating may be used as the drive element.

(5) In the above-mentioned embodiment, although the serial type liquid ejecting apparatus 100 in which the transport body 41 on which the liquid ejection head 50 is mounted is reciprocated is exemplified, the present disclosure is also applied to a line type liquid ejecting apparatus in which a plurality of nozzles N is distributed over the entire width of the medium 11.

(6) The liquid ejecting apparatus 100 exemplified in the above embodiment can be adopted not only in a device dedicated to printing but also in various devices such as a facsimile machine and a copying machine. Further, the application of the liquid ejecting apparatus of the disclosure is not limited to printing. For example, the liquid ejecting apparatus that ejects a solution of a coloring material is used as a manufacturing apparatus that forms a color filter of a display device such as a liquid crystal display panel. The liquid ejecting apparatus that ejects a solution of a conductive material is used as a manufacturing apparatus that forms wirings and electrodes of a wiring substrate. The liquid ejecting apparatus that ejects a solution of an organic substance relating to a living body is used as a manufacturing apparatus that manufactures a biochip, for example.

C: Appendix

For example, the following configurations can be grasped from the embodiments exemplified above.

In a method of controlling a liquid ejecting apparatus according to one aspect (first aspect), where the liquid ejecting apparatus includes a pressure chamber that communicates with a nozzle that ejects a liquid, a drive element that changes a pressure of the liquid in the pressure chamber, and a drive circuit that supplies the drive element with an ejection pulse that generates a change in the pressure that ejects the liquid from the nozzle, the method includes specifying a viscosity of the liquid in the nozzle and a surface tension of the liquid in the nozzle from a residual vibration when the pressure of the liquid in the pressure chamber is changed, and controlling a waveform of the ejection pulse according to the viscosity and the surface tension. In the above aspect, the waveform of the ejection pulse is controlled according to the viscosity of the liquid in the nozzle and the surface tension of the liquid. Therefore, even when the physical properties of the liquid in the nozzle are changed, it is possible to reduce the error relating to the ejection characteristic of the liquid. The ejection characteristic is, for example, the ejection amount, the ejection speed or the ejection direction.

In the specific example of the first aspect (second aspect), the specifying the viscosity includes specifying the viscosity from an attenuation factor of the residual vibration. Since the viscosity correlates with the attenuation factor of the residual vibration, the viscosity of the liquid can be specified with high accuracy according to the above aspect.

In the specific example of the second aspect (third aspect), the viscosity specified when the attenuation factor is a first value is less than the viscosity specified when the attenuation factor is a second value that is greater than the first value. Since the attenuation factor of the residual vibration tends to monotonically increase with respect to the viscosity of the liquid in the nozzle the actual viscosity of the liquid can be specified with high accuracy according to the above aspect.

In the specific example of any of the first aspect to the third aspect (fourth aspect), the specifying the surface tension includes specifying the surface tension from a frequency of the residual vibration. Since the surface tension correlates with the frequency of the residual vibration, the surface tension of the liquid can be specified with high accuracy according to the above aspect. The configuration that specifies the surface tension from the cycle of the residual vibration is substantially the same as the configuration that specifies the surface tension from the frequency of the residual vibration.

In the specific example of the fourth aspect (fifth aspect), the surface tension specified when the frequency is a third value is less than the surface tension specified when the frequency is a fourth value that is greater than the third value. Since the frequency of residual vibration tends to increase monotonically with the surface tension of the liquid in the nozzle, the surface tension of liquid can be specified with high accuracy according to the above aspect.

In the specific example of any of the first aspect to the fifth aspect (sixth aspect), the nozzle has a total length, of a section having a smallest inner diameter in an axial direction of the nozzle, that is 30 μm or more. In the configuration in which the total length of the section having the smallest diameter of the nozzle is less than 30 μm, the change in the attenuation factor with respect to the total length is remarkable. Assuming the above circumstances, the attenuation factor of the residual vibration can be stably specified according to the configuration in which the total length of the section having the smallest diameter is 30 μm or more.

In the specific example of any of the first aspect to the sixth aspect (seventh aspect), the controlling the waveform of the ejection pulse includes controlling an amplitude value of the ejection pulse so that an amplitude value of the ejection pulse when the viscosity is a fifth value is less than an amplitude value of the ejection pulse when the viscosity is a sixth value that is greater than the fifth value. In the above aspect, the waveform of the ejection pulse is controlled such that the higher the viscosity of the liquid in the nozzle, the larger the amplitude value of the ejection pulse. Therefore, even when the viscosity of the liquid in the nozzle changes, it is possible to reduce the error relating to the ejection characteristic of the liquid.

In the specific example of any of the first aspect to the seventh aspect (eighth aspect), the controlling the waveform of the ejection pulse includes controlling an amplitude value of the ejection pulse so that an amplitude value of the ejection pulse when the surface tension is a seventh value is less than an amplitude value of the ejection pulse when the surface tension is an eighth value that is greater than the seventh value. In the above aspect, the waveform of the ejection pulse is controlled such that the higher the surface tension of the liquid in the nozzle, the larger the amplitude value of the ejection pulse. Therefore, even when the surface tension of the liquid in the nozzle changes, the error relating to the liquid ejection characteristic can be reduced.

A liquid ejecting apparatus according to another aspect (ninth aspect) includes a pressure chamber that communicates with a nozzle that ejects a liquid, a drive element that changes a pressure of the liquid in the pressure chamber, a drive circuit that supplies the drive element with an ejection pulse that generates a change in the pressure that ejects the liquid from the nozzle, a specifying unit that specifies a viscosity of the liquid in the nozzle and a surface tension of the liquid in the nozzle from a residual vibration when the pressure of the liquid in the pressure chamber is changed, and a controller that controls a waveform of the ejection pulse according to the viscosity and the surface tension.

What is claimed is:

1. A method of controlling a liquid ejecting apparatus, the liquid ejecting apparatus including a pressure chamber that communicates with a nozzle that ejects a liquid, a drive element that changes a pressure of the liquid in the pressure chamber, and a drive circuit that supplies the drive element with an ejection pulse that generates a change in the pressure that ejects the liquid from the nozzle, the method comprising:

specifying a viscosity of the liquid in the nozzle and a surface tension of the liquid in the nozzle from a residual vibration when the pressure of the liquid in the pressure chamber is changed; and controlling a waveform of the ejection pulse according to the viscosity and the surface tension.

2. A method of controlling a liquid ejecting apparatus according to claim 1, wherein the specifying the viscosity includes specifying the viscosity from an attenuation factor of the residual vibration.

3. The method of controlling the liquid ejecting apparatus according to claim 2, wherein the viscosity specified when the attenuation factor is a first value is less than the viscosity specified when the attenuation factor is a second value that is greater than the first value.

4. The method of controlling a liquid ejecting apparatus according to claim 1, wherein the specifying the surface tension includes specifying the surface tension from a frequency of the residual vibration.

5. The method of controlling the liquid ejecting apparatus according to claim 4, wherein the surface tension specified when the frequency is a third value is less than the surface tension specified when the frequency is a fourth value that is greater than the third value.

6. The method of controlling a liquid ejecting apparatus according to claim 1, wherein the nozzle has a total length, of a section having a smallest inner diameter in an axial direction of the nozzle, that is 30 μm or more.

7. The method of controlling a liquid ejecting apparatus according to claim 1, wherein the controlling the waveform of the ejection pulse includes controlling an amplitude value of the ejection pulse so that an amplitude value of the ejection pulse when the viscosity is a fifth value is less than an amplitude value of the ejection pulse when the viscosity is a sixth value that is greater than the fifth value.

8. The method of controlling a liquid ejecting apparatus according to claim 1, wherein the controlling the waveform of the ejection pulse includes controlling an amplitude value of the ejection pulse so that an amplitude value of the ejection pulse when the surface tension is a seventh value is less than an amplitude value of the ejection pulse when the surface tension is an eighth value that is greater than the seventh value.

9. A liquid ejecting apparatus comprising:

a pressure chamber that communicates with a nozzle that ejects a liquid;

a drive element that changes a pressure of the liquid in the pressure chamber;

a drive circuit that supplies the drive element with an ejection pulse that generates a change in the pressure that ejects the liquid from the nozzle;

a specifying unit that specifies a viscosity of the liquid in the nozzle and a surface tension of the liquid in the nozzle from a residual vibration when the pressure of the liquid in the pressure chamber is changed; and a controller that controls a waveform of the ejection pulse according to the viscosity and the surface tension.

10. The liquid ejecting apparatus according to claim 9, wherein the specifying unit specifies the viscosity from a attenuation factor of the residual vibration.

11. The liquid ejecting apparatus according to claim 10, wherein the viscosity specified when the attenuation factor is a first value is less than the viscosity specified when the attenuation factor is a second value that is greater than the first value.

12. The liquid ejecting apparatus according to claim 9, wherein the specifying unit specifies the surface tension from a frequency of the residual vibration.

13. The liquid ejecting apparatus according to claim 12, wherein the surface tension specified when the frequency is a third value is less than the surface tension specified when the frequency is a fourth value that is greater than the third value.

14. The liquid ejecting apparatus according to claim 9, wherein the nozzle has a total length, of a section having a smallest inner diameter in an axial direction of the nozzle, that is 30 μm or more.

15. The liquid ejecting apparatus according to claim 9, wherein the controller controls an amplitude value of the ejection pulse so that an amplitude value of the ejection pulse when the viscosity is a fifth value is less than an amplitude value of the ejection pulse when the viscosity is a sixth value that is greater than the fifth value.

16. The liquid ejecting apparatus according to claim 9, wherein the controller controls an amplitude value of the ejection pulse so that an amplitude value of the ejection pulse when the surface tension is a seventh value is less than an amplitude value of the ejection pulse when the surface tension is an eighth value that is greater than the seventh value.

* * * * *